United States Patent [19]

Mizelle

[11] Patent Number: 4,844,536

[45] Date of Patent: Jul. 4, 1989

[54] EXTENSIBLE LEGREST MECHANISM FOR FURNITURE SEATING UNITS

[76] Inventor: Ned W. Mizelle, P.O. Box 5985, High Point, N.C. 27262

[21] Appl. No.: 67,825

[22] Filed: Jun. 30, 1987

Related U.S. Application Data

[63] Continuation-in-part of Ser. No. 917,474, Oct. 10, 1986, abandoned.

[51] Int. Cl.[4] ..... A47C 7/50

[52] U.S. Cl. ..... 297/68; 297/84

[58] Field of Search ..... 297/68, 430, 431, 429, 297/69, 75, 84, 355, 354, 361

[56] References Cited

U.S. PATENT DOCUMENTS

| | | | |
|---|---|---|---|
| 901,285 | 10/1908 | Eyles | 297/84 |
| 3,295,885 | 1/1967 | Barksdale | 297/84 |
| 3,880,462 | 4/1975 | Mednick | 297/84 |
| 4,185,870 | 1/1980 | Johnson | 297/84 |

FOREIGN PATENT DOCUMENTS

| | | | |
|---|---|---|---|
| 2371169 | 6/1978 | France | 297/84 |

*Primary Examiner*—Peter A. Aschenbrenner
*Attorney, Agent, or Firm*—Beveridge, DeGrandi & Weilacher

[57] ABSTRACT

An extensible legrest mechanism for a seating unit includes a movable legrest assembly mounted on a stationary support assembly. The legrest assembly has a pair of longitudinally movable struts which support a transverse leg-supporting member. The support assembly supports the struts in a cantilevered manner for longitudinal movement.

The legrest assembly is biased toward its extended position by a spring, a reel, and a flexible member which is wound on the reel and is connected to one of the assemblies. A brake is mounted on the support assembly and has brake shoes which are engageable with the struts and are conformable to the struts to exclude air and to provide intimate physical contact which prevents longitudinal strut movement. The brakes are operated by a pair of brake levers which are biased to positions where the shoes engage the struts, and the levers are manually operated to oppose the bias and retract the brake shoes from the struts. The leg-supporting member is pivotally connected to the struts, and a resilient member is used to bias the legsupporting member to a predetermined angular position with respect to the struts. A resiliently biased manually retractable latch is provided for engaging keepers on the movable legrest in order to hold the legrest at its extended and/or retracted position.

13 Claims, 6 Drawing Sheets

EXTENSIBLE LEGREST MECHANISM FOR FURNITURE SEATING UNITS

REFERENCE TO RELATED APPLICATION

This is a continuation-in-part of U.S. patent application Ser. No. 917,474, filed Oct. 10, 1986, now abandoned.

BACKGROUND OF THE INVENTION

This invention relates to improvements in legrests for seating units such as chairs and sofas.

Extensible legrests are widely used in recliner and incliner type furniture. Normally, a legrest is extensible by a scissors-like linkage which moves a leg-supporting member from a retracted position to an extended position. Many mechanisms of this nature are available, and they are commonly moved from one position to another by a lever and/or by leg pressure.

The present invention differs from most commercially available products of its type in the respect that this invention utilizes longitudinally movable struts which hold the leg-supporting member in a cantilevered fashion. Devices of this general type are described in the patent literature but they are not commonly known or used in the modern furniture industry.

The present invention is directed to various improvements in the extensible strut type of extensible legrest mechanism, with improvements relating to a simplified structure which operates effectively, is durable, is suitable for use in furniture having a great variety of styles, and is aesthetically pleasing.

SUMMARY OF THE INVENTION

This invention relates to improvements in extensible legrest mechanisms of the type which have a legrest assembly which has a leg-supporting member transversely mounted on a pair of longitudinally movable strut members, and a support assembly provided with means for supporting the struts for longitudinal movement and for supporting the struts in a cantilevered manner when the legrest assembly is in its extended position.

One feature of the invention is the utilization of a resilient means having a spring, a reel and a flexible member which is wound on the reel. The reel and the outer end portion of the flexible member are connected to different assemblies so that the resilient means will bias the legrest assembly toward its extended position.

Another feature pertains to a brake means which has a brake shoe which is deformable and is conformable to a strut it engages, thereby excluding air from between the brake shoe and the strut to provide initimate physical contact to prevent longitudinal movement of the strut.

Another feature pertains to the connection between the leg-supporting member and the strut members. The leg-supporting member is pivotally connected for movement about a transverse pivot axis, and resilient means are operable between the leg-supporting member and a strut to bias the leg-supporting member to a predetermined angular position with respect to the strut.

Still another feature of the invention is the brake actuating mechanism. Brake shoes are engageable with the struts to prevent longitudinal movement thereof, and the brake operating means includes a pair of brake levers which are pivotally mounted on the support assembly. The brake shoes are mounted on the brake levers, resilient means are provided for biasing the brake levers to positions where the brake shoes engage the struts, and manually operable means are provided for opposing the resilient means to move the brake levers to positions where the brake shoes are retracted from the struts.

Another feature is the provision of a latch means for holding the movable legrest assembly in its extended or retracted positions. In this regard, the invention involves a latch member on the support assembly which is engageable with one or more keepers on the movable legrest assembly. The latch member is movable between its locking and unlocked positions by an actuator cable which is manually operable by a user. The latch member has a special configuration which provides for convenient latching, releasing, and movement of the legrest assembly between its latched extended position and a latched retracted position.

DETAILED DESCRIPTION

Figure 1:
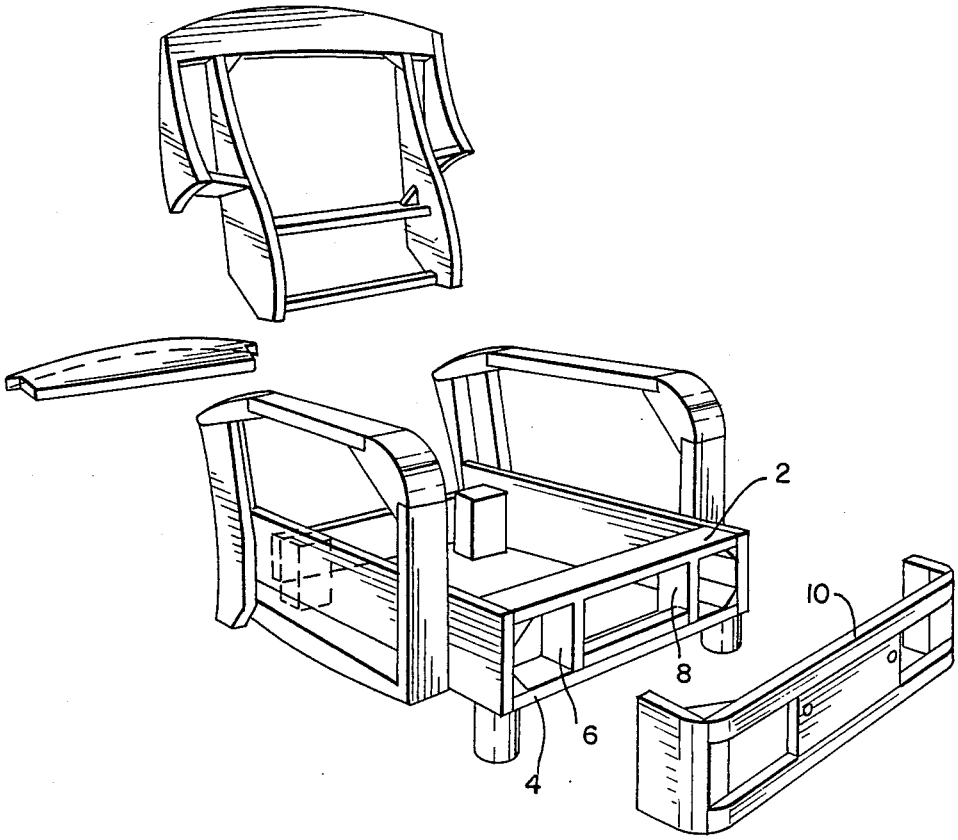
FIG. 1 is an exploded view of a chair frame constructed for use in accordance with the mechanism of this invention.

This invention relates to a legrest mechanism for seating articles of furniture, and to articles of furniture constructed with such mechanisms. Preferably, the seating units are chairs, sofas or the like which are upholstered and are provided with reclinable backs; however, the mechanism may also be used with other types of furniture. A typical wooden frame for an upholstered piece of furniture with an inclinable back is shown in FIG. 1. The component most pertinent to this invention is the split front rail which has an upper front rail 2 and a lower front rail 4. Vertical front rail sections 6 and 8 are also provided. In the completed article of furniture, the legrest frame 10 is nested around the front end of the main frame, and these components are connected together by the mechanism described below.

Figure 2:
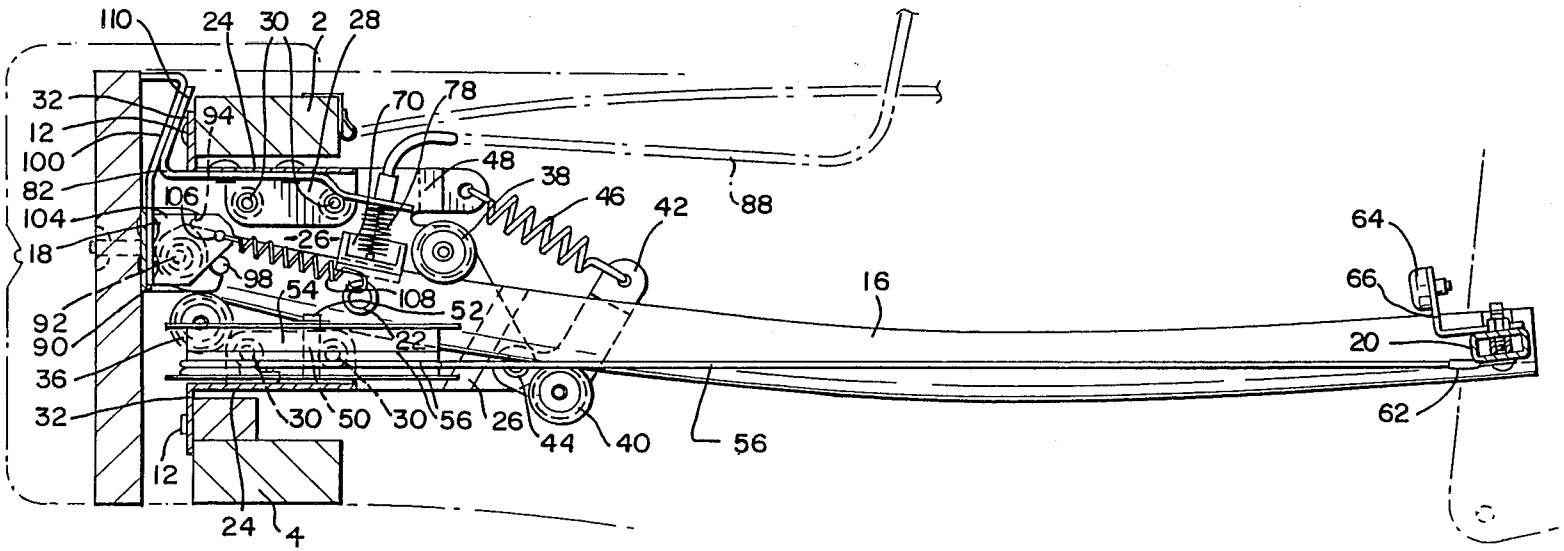
FIG. 2 is a sectional side view of a mechanism constructed according to the invention.
Figure 3:
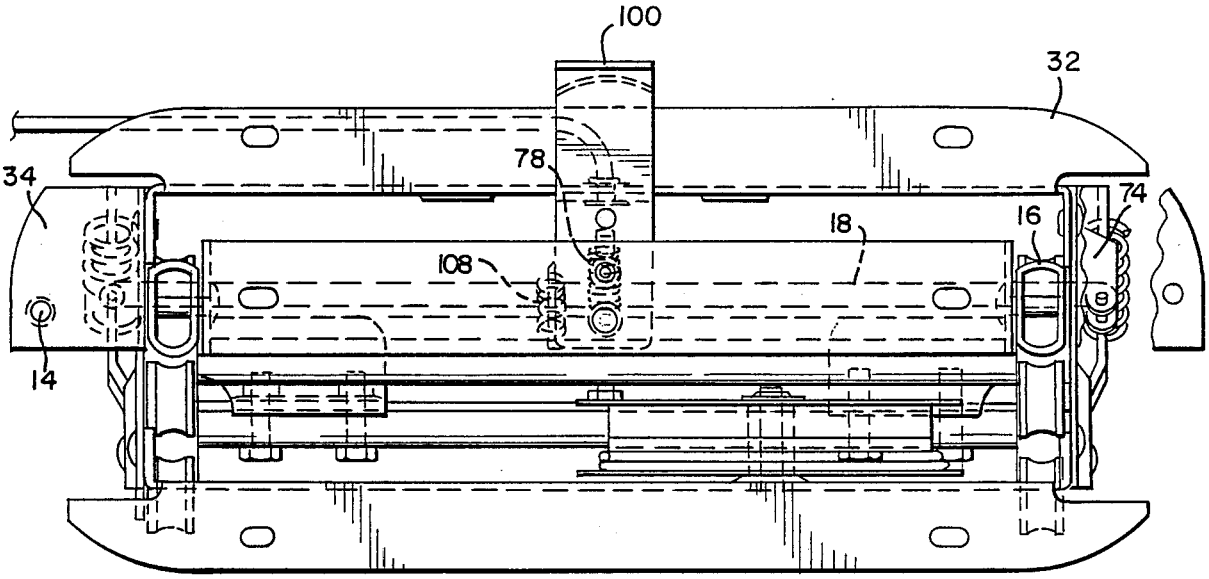
FIG. 3 is a front view of the mechanism.

As shown in FIG. 2, the legrest mechanism is attached to the top rail 2 and bottom rail 4 by screws 12 or other suitable fasteners. Additionally, fasteners can extend through the holes 14 shown in FIG. 3 to attach the mechanism to the vertical rails 6 and 8.

Figure 5:
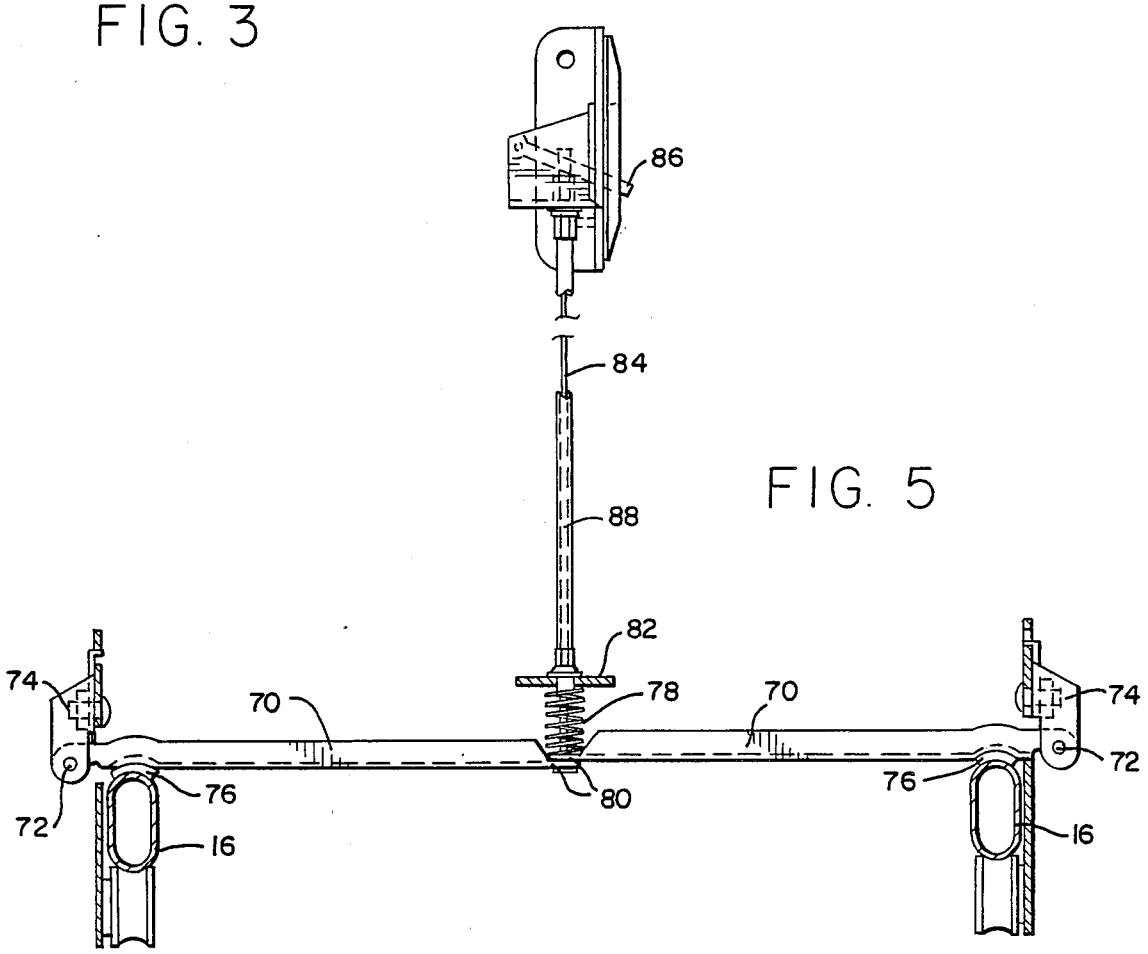
FIG. 5 is a rearwardly looking transverse sectional view of the mechanism.
Figure 4:
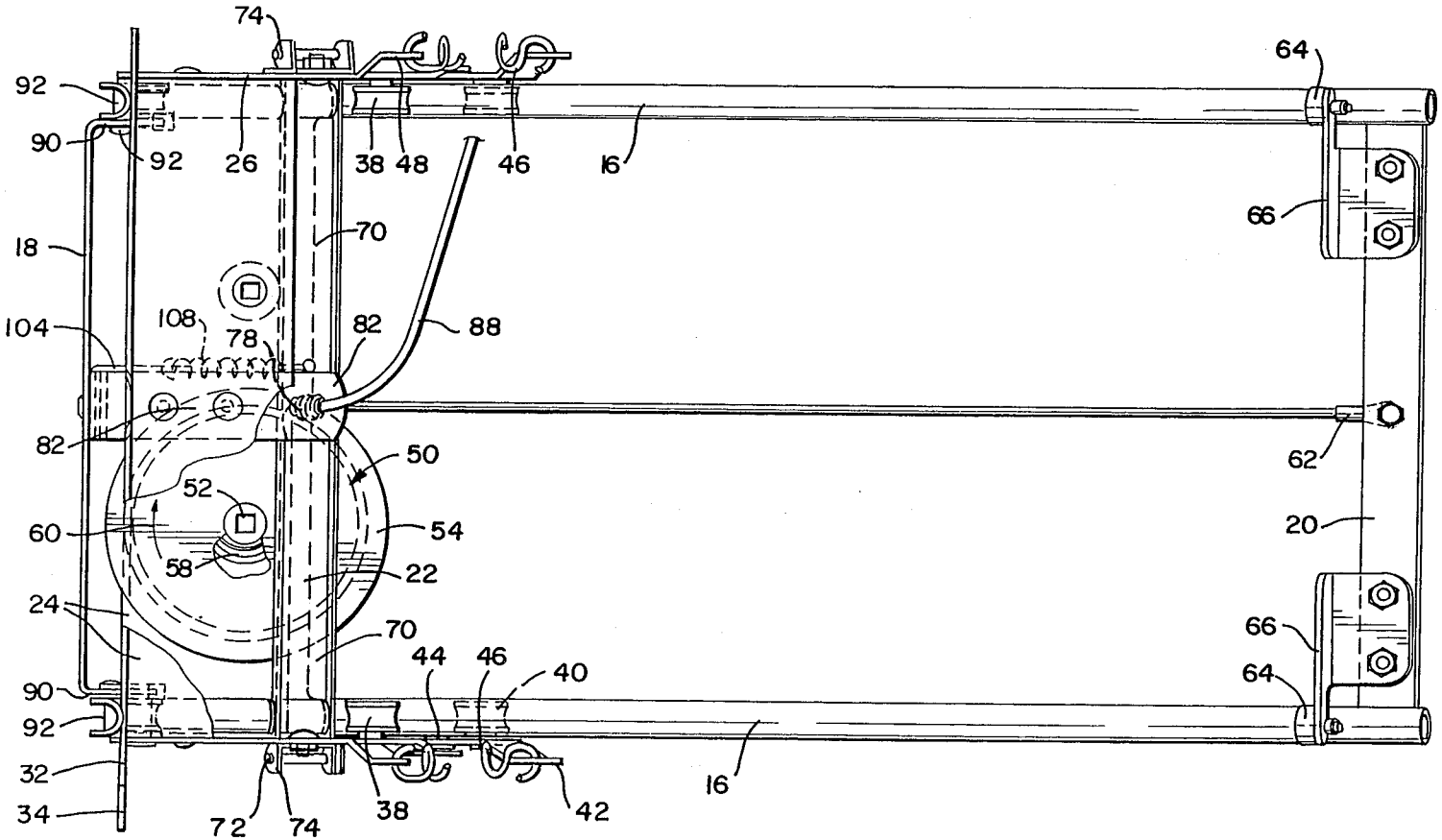
FIG. 4 is a plan view of the mechanism.
Figure 6:
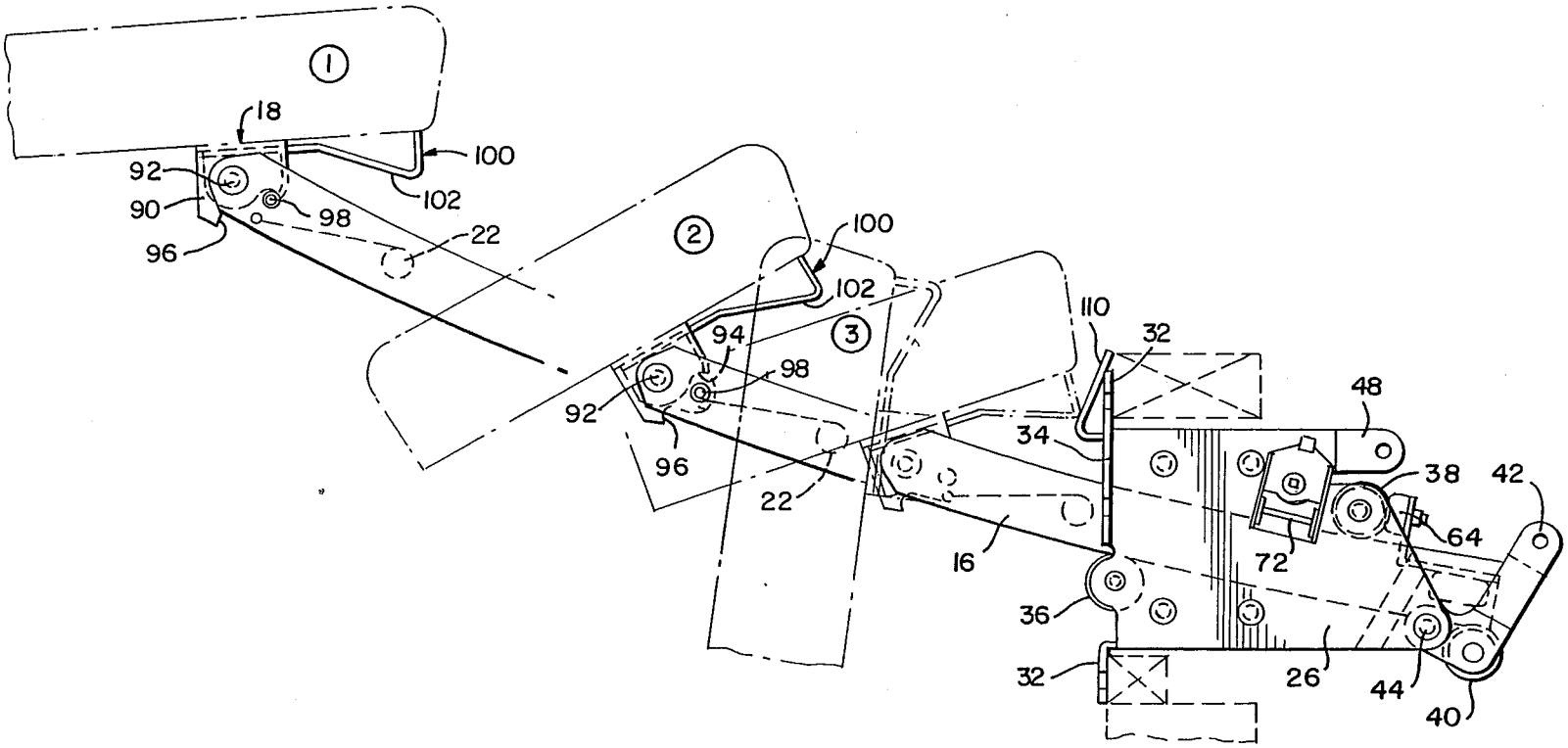
FIG. 6 is a view showing the movable legrest assembly at various extended postions.

The mechanism includes a longitudinally movable legrest assembly which, as shown in FIG. 4, has a pair of longitudinally movable strut members 16, a transverse leg-supporting member 18, and two transverse cross tubes 20 and 22 which are welded to the strut members 16. As can be seen in FIG. 6, the struts 16 are nonlinear so that, as they move forwardly, they also tend to elevate the leg-supporting components at the forward end thereof. This non-linearity may be due to a gradual curvature as shown, or it may be provided by forming one or more slight bends in linear tube sections. As can be seen in FIG. 5, the struts 16 have an ovalshaped cross section which has proven to be particularly advantageous from the standpoint of strength, effectiveness and aesthetics.

The stationary assembly which is mounted on the furniture frame and which supports the movable legrest assembly has a box-like chassis formed of identical top and bottom pieces 24 and mirror image vertical end pieces 26. The pieces 24 have flanges 28 which lie in vertical longitudinal planes and are riveted to the end pieces at 30. Vertical mounting flanges 32 are located at the front of the pieces 24, and outturned vertical mounting flanges 34 are likewise provided at the forward edges of the end pieces 26. As previously mentioned, the chassis is connected to a split front rail of a chair frame by fasteners which extend through the openings in the flanges 32 and 34.

As best seen in FIG. 2, the end pieces 26 of the chassis each carry three rollers 36, 38 and 40, each of these rollers being provided with a circumferential groove which corresponds to the shape of the legrest-supporting struts. The pivot axes of rollers 36 and 38 are stationary but, to accommodate dimensional variations and to assure that all three rollers are continuously engaged firmly with the strut, the roller 40 is movable and is resiliently biased against the strut. Each roller 40 is mounted on a bellcrank lever 42 which has one end pivoted to the end piece at 44 and another end connected to a spring 46, the opposite end of which is hooked to a laterally offset ear 48 on the end piece 26.

The legrest assembly is resiliently biased toward it fully extended position, and it is lockable in any partially extended position selected by the occupant. This locking effect is due to a brake mechanism which is described later in this specification. The legrest assembly is biased forwardly by a conventional power spring reel mechanism 50 which is supported on a nonrotating shaft 52 on the bottom piece 24 of the chassis. This spring reel mechanism, sometimes referred to simply as a power spring, includes a reel 54 mounted on the shaft 52. An elongated flexible member 56, typically a wire, is wound on the reel. The rotatable reel 54 is connected to the nonrotatable shaft 52 by a spring schematically shown at 58, this spring being arranged to rotate the reel in a direction designated by the arrow 60 to wind the wire 56 onto the reel. A fitting 62 at the distal end of the wire is fastened to the rear cross tube 20 of the legrest assembly so that, as the internal spring in the mechanism 50 tends to wind the wire 56 on the reel 54, it also tends to pull the movable legrest assembly in a forward direction. The maximum extent of such movement is limited by stops 64 which are mounted on the rear cross tube 20 by brackets 66. These stops 64 are in the same longitudinal vertical plane as the struts 16 and rollers 36, 38 and 40. When the movable legrest assembly moves forwardly, the stops 64 eventually contact the rollers 38 as shown in FIG. 6, thereby preventing any further forward movement of the legrest assembly.

Due to physiological and preferential factors, different occupants of the chair or other seating unit are able to select their own legrest extension distances and angles. The distance selection capability is due to the braking mechanism which is infinitely adjustable within the limits of legrest travel. As best shown in FIG. 5, this braking mechanism has a pair of transverse brake levers 70 which have their outboard ends pivotally connected at 72 to pivot brackets 74 which are affixed to the end pieces 26 of the mechanism. Each of these brake levers 70 has a brake shoe 76 which is movable into and out of braking engagement with the struts 16. The brakes are normally held in their engaged braking positions by a spring 78 which acts against overlapping end portions 80 of the levers 70 at the longitudinal centerline of the mechanism. This spring 78 is a compression spring mounted beneath a center piece 82 which is affixed to the top piece 24 by rivets.

To release the brakes, a brake release cable 84 extends centrally through the spring 78 and has its end operatively connected to the levers 70 where they overlap. The opposite end of the cable is connected to a manually operable lever 86 which is mounted where it can be conveniently operated by the occupant of the chair. The inside surface of a chair arm is one suitable location. The cable is preferably a Boden wire device which has a sheath 88. The opposite ends of the sheath 88 are always stationary, and the release cable 84 moves lengthwise within this sheath.

Preferably, the brake shoes 76 are formed of a soft material which provides a braking surface which is deformable and conformable to the strut when the brakes are engaged. The conformablility excludes air from between the brake shoe and the strut so as to provide intimate physical contact preventing longitudinal movement of the strut. It is believed that any tendency of the strut to move is resisted by a vacuum which is produced at the interface between these elements.

As previously mentioned, the leg supporting member includes the transverse piece 18. Its opposite ends have rearwardly turned ears 90, and these ears are connected to the struts 18 by aligned transverse pivot pins 92 which are best shown in FIG. 6. The edges of these ears 90 are shaped to provide stop surfaces 94 and 96 which, when the legrest piece 18 rotates, are movable into contact with stop pins 98 which are affixed to the struts 18. This limits the pivoting movement of the legrest with respect to the struts.

A center piece 100 is attached to the center of the transverse legrest piece 18, and this center piece 100 has an upper extension forming a cam surface 102 best seen in FIGS. 2 and 6. The piece 100 also has a flange 104 which lies in a vertical longitudinal plane and has a hole 106 for receiving one end of a tension spring 108. The opposite end of this spring 108 is attached to the forward crosstube 22 of the legrest assembly. As can be seen in FIGS. 2 and 6, this spring 108 biases the member 18 in a clockwise direction when the member 18 is in the vertically retracted position shown in FIG. 2. However, such clockwise movement is prevented in FIG. 2 due to the engagement between the rearwardly facing cam surface 102 and a forwardly facing cam surface 110 which is located at the forward end of the previously-described center piece 82 on the stationary chassis of the mechanism.

When the legrest is moved forwardly from its retracted position, the spring 108 rotates the legrest piece to a position which is about midway between its limits of pivotal movement. The tension in spring 108 is low enough so that the angle of the legrest will self-adjust to the angle of the occupant's leg. However, when the legrest is at its fully extended position as shown in FIG. 6, the stop surface 94 will engage the stop pin 98 on the strut 16 to prevent any further clockwise movement.

The occupant may move the legrest assembly to its retracted position by using lever 86 to release the brake, while pressing his or her legs in an inward direction. During this travel, the angle of the legrest will self-adjust until the cam surface 102 engages the cam surface 110 to move the legrest to the stored upright position shown in FIG. 2.

Figure 7:
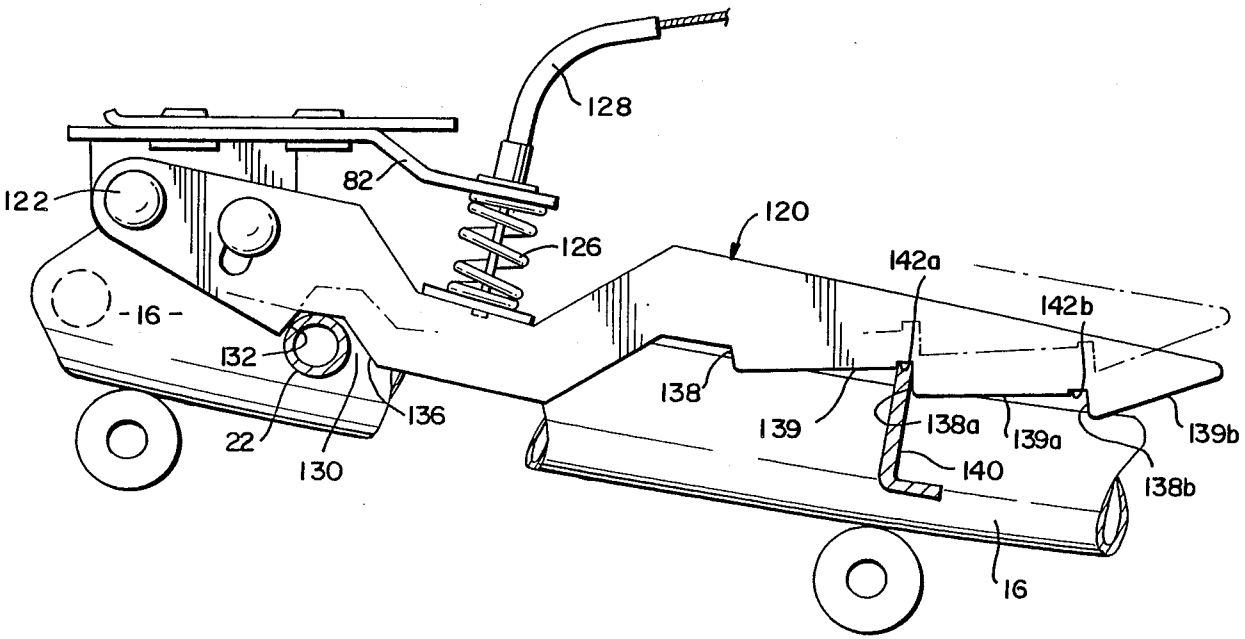
FIG. 7 is a side view of a latching mechanism according to the invention.

In some situations, it is desirable to provide a locking mechanism which holds the movable legrest assembly at a stationary extended or retracted position. One such mechanism which can be used in addition to or in lieu of the braking means illustrated in FIG. 5 is shown in FIG. 7. This mechanism includes a molded plastic or metal latch member 120 which is pivotally mounted at 122 on the stationary piece 82. The solid lines show the latch in its latching position, and the broken lines show the outline of its unlatched positions. A compression spring 126 normally biases the latch toward its latching position, but the lever is movable to its unlatched position by a manually operated cable actuator 128, the remote end of which is provided with a manually operated lever such as the one shown at 86 in FIG. 5.

The latch has a forward notch 130 with a rearwardly-facing detent surface which in FIG. 7 engages the crosstube 22 of the movable legrest assembly. In this respect, the crosstube serves as a keeper. The rear of the notch 130 is inclined at 136 in order to prevent damage to the mechanism in case there is inadvertent rearward overtravel of the legrest assembly when it is moved to its retracted position. In this regard, the surface 136 acts as a latch-lifting cam so that any overtravel will simply cause the latch to pivot upwardly to avoid damage by any impact forces.

The rear portion of the latch member is provided with one or more forwardly-facing detent surfaces 138, 138*a* and 138*b* which prevent rearward movement of the movable legrest assembly when it is in an extended position. These surfaces 138, 138*a* and 138*b* are engageable with an L-shaped crosspiece 140 which is rigidly attached to the movable legrest assembly toward the rear portion thereof. When the legrest is extended, the crosspiece will be in the vicinity of the latch 120, as shown in FIG. 7. The crosspiece 140 serves as a keeper after the movable legrest assembly has moved forwardly to an extended position. During the forward movement, the latch is automatically lifted when the forwardly-moving keeper 140 moves along the cam surfaces 139, 139*a* and 139*b* which extend rearwardly from the detent surfaces.

Although it is possible to use only a single detent surface 138, plural detent surfaces are desirable because they give the user some selectivity in arriving at a forward position of the legrest which is most comfortable.

An optional feature of the latch assembly shown in FIG. 7 is the provision of rearwardly facing supplemental detent surfaces 142*a* and 142*b* which are proximate to and face toward the detent surfaces 138*a* and 138*b*. These supplemental detents are desirable because they prevent the legrest assembly from being moved forwardly by the power spring 50 in situations where the legrest assembly is in its extended position and the user removes his feet from the leg-supporting member.

The operation of the latching mechanism will now be explained. When the legrest is retracted, the mechanism will be held in the condition shown in FIG. 7 due to engagement of the forward keeper 22 by the detent surface 132. To extend the legrest, the user operates the lever to pull the cable 128, thereby compressing the spring 126 and pivoting the latch about the pivot member 122. This releases the forward keeper 22 and legrest assembly for forward movement. Toward the end of this forward movement, the rear keeper 140 moves into contact with one or more of the cam surfaces 139, 139*a* and 139*b*, and this action causes the latch to pivot upwardly to a retracted position. The spring 126 continues to bias the latch downwardly so that, at some point, the user may discontinue the forward movement of the legrest and permit the rear keeper 140 to seat itself against one of the forwardly facing detent surfaces 138, 138*a* and 138*b*. In the selected position, the legrest assembly is securely held against any rearward movement. If the supplemental detent surfaces 142*a* and 142*b* are provided, forward movement of the legrest assembly by the power spring mechanism 50 is also prevented.

Whenever the user wants to restore the legrest to its retracted position, he simply operates the cable actuator 128 to lift the latch 120 until the engaged detent surface 138, 138*a* or 138*b* is disengaged from the rear keeper 140, thus enabling the legrest assembly to move rearwardly until the front keeper 22 again arrives in the notch 130. During the latter part of the rearward travel, the surface 136 of the latch has a camming effect which raises the latch to prevent damage to the latch if there is overtravel.

From the foregoing, it will be appreciated that this invention provides a simple yet highly effective and desirable means for providing a piece of furniture with an extensible legrest. Persons familiar with the art will appreciate that the embodiment described in this specification may be modified in many ways. Therefore, it is emphasized that the invention is not limited solely to the disclosed embodiment but is embracing of modifications and variations thereof which fall within the spirit of the following claims.

I claim:

1. An extensible legrest for a seating unit, comprising a movable legrest assembly mounted on a stationary support assembly, said legrest assembly having a pair of longitudinally movable strut members and a transverse leg-supporting member, said leg-supporting member being mounted on the strut members and being longitudinally movable therewith between a retracted position and an extended position, said leg-supporting member providing means for underlying and supporting a leg of a person occupying the seating unit, said support assembly having means for supporting the struts for longitudinal movement and for supporting the struts in a cantilevered manner when the legrest assembly is in its extended position, said mechanism having lock means which is operable to hold the movable legrest assembly at a stationary position relative to said stationary support assembly when the movable legrest assembly is at its extended position, said lock means including a latch member on the support assembly and a keeper member on the movable legrest assembly, said latch member being movable from a locking position where it engages the keeper to an unlocked position where it is retracted from the keeper, and manually operable means for moving the latch member between its locking and unlocked positions.

2. An extensible legrest mechanism according to claim 1 wherein there are first and second keeper members on the movable legrest assembly, said latch member having a first detent surface which is engageable with said first keeper member to hold the legrest assembly in its retracted position, said latch member having a second detent surface which is engageable with said second keeper member to lock said legrest assembly in said extended position.

3. An extensible legrest mechanism according to claim 1 wherein the latch member has a plurality of detent surfaces which are spaced apart and face in a same direction so as to lock the movable legrest assembly in a plurality of different extended positions.

4. An extensible legrest mechanism according to claim 1 wherein the latch has a fowardly facing detent surface and a latch-lifting cam surface which is rearward of said detent surface, said cam surface being engageable by said keeper when the legrest assembly is moving forwardly to raise the latch member to permit forward movement of said keeper to a position where it is engageable by said detent surface.

5. An extensible legrest mechanism according to claim 4 wherein the latch has a plurality of said cam surfaces and detents to provide a pluralty of user-selectable extended positions of the legrest assembly.

6. An extensible legrest mechanism according to claim 4 wherein the latch member is also provided with a rearwardly facing supplemental detent surface which is near said forwardly facing detent surface and is operable to prevent forward movement of the legrest assembly when it is at an extended position.

7. An extensible legrest mechanism according to claim 1 wherein said latch has a rearwardly facing detent surface for holding the movable legrest assembly in its retracted position and, to prevent damage to the latch in the event of rearward overtravel of the legrest assembly when it is moved to its retracted position, the latch has a latch-lifting cam surface which is rearward of said detent surface and is inclined in a direction which moves the latch toward its retracted position in the event of rearward overtravel of the legrest assembly from its retracted position.

8. An extensible legrest for a seating unit, comprising a movable legrest assembly mounted on a stationary support assembly, said legrest assembly having a pair of longitudinally movable strut members and a transverse leg-supporting member, said leg-supporting member being mounted on the strut members and being longitudinally movable therewith between a retracted position and an extended position, said leg-supporting member providing means for underlying and supporting a leg of a person occupying the seating unit, said support assembly having means for supporting the struts for longitudinal movement and for supporting the struts in a cantilevered manner when the legrest assembly is in its extended position, said mechanism having resilient means for biasing the legrest assembly toward its extended position, said resilient means including a spring, a reel, and a flexible member which is wound on said reel and has an outer end portion extending from said reel, said reel and said outer end portion of the flexible member being connected to different said assemblies.

9. An extensible legrest for a seating unit, comprising a movable legrest assembly mounted on stationary support assembly, said legrest assembly having a pair of longitudinally movable strut members and a transverse leg-supporting member, said leg-supporting member being mounted on the strut members and being longitudinally movable therewith between a retracted position and an extended position, said leg-supporting member providing means for underlying and supporting a leg of a person occupying the seating unit, said support assembly having means for supporting the struts for longitudinal movement and for supporting the struts in a cantilevered manner when the legrest assembly is in its extended position, said mechanism having brake means which are engageable to prevent longitudinal movement of the struts, said brake means including at least one brake shoe which is mounted on said support assembly and has a braking surface which is movable into contact with a said strut, said braking surface being deformable and being conformable to the strut to exclude air from between the brake shoe and the strut so as to provide intimate physical contact which prevents longitudinal movement of said strut.

10. An extensible legrest for a seating unit, comprising a movable legrest assembly mounted on a stationary support assembly, said legrest assembly having a pair of longitudinally movable strut members and a transverse leg-supporting member, said leg-supporting member being mounted on the strut members and being longitudinally movable therewith between a retracted position and an extended position, said leg-supporting member providing means for underlying and supporting a leg of a person occupying the seating unit, said support assembly having means for supporting the struts for longitudinal movement and for supporting the struts in a cantilevered manner when the legrest assembly is in its extended position, said mechanism having brake shoes which are engageable with the struts to prevent longitudinal movement of the struts, brake operating means including a pair of brake levers which are pivotally mounted on said support assembly, said brake shoes being mounted on said brake levers, resilient means for biasing the brake levers to positions where their respective said brake shoes engage the struts, and manually operable means for opposing said resilient means and moving the brake levers to positions where the brake shoes are retracted from said struts.

11. An extensible legrest mechanism according to claim 10 wherein the levers are disposed transversely, said levers being pivotally connected to the support assembly at locations which are outboard of the struts and being connected to the manually operable means at a location which is between the struts.

12. An extensible legrest mechanism according to claim 10 wherein the manually operable means include a manually operable lever and an actuator cable which connects the manually operable lever to the brake levers.

13. An extensible legrest mechanism according to claim 10 wherein said brake shoes are formed of a material which is deformable and provides a braking surface which is conformable to the struts to exclude air from between the brake shoes and the struts so as to provide intimate physical contact which prevents longitudinal movement of said struts.

* * * * *